United States Patent [19]

Clements

[11] Patent Number: 4,790,392

[45] Date of Patent: Dec. 13, 1988

[54] SOIL SAMPLE CORE EXTRACTION TOOL

[76] Inventor: James M. Clements, R.R. 1, Box 186, Newton, Iowa 50208

[21] Appl. No.: 90,083

[22] Filed: Aug. 24, 1987

[51] Int. Cl.[4] ..... E21B 11/02; E21B 25/00; E21B 49/02

[52] U.S. Cl. ..... 175/20; 173/90; 173/128; 175/135

[58] Field of Search ..... 175/20, 135, 308, 309; 294/50.6, 50.7; 173/90, 91, 128, 132

[56] References Cited

U.S. PATENT DOCUMENTS

| | | | |
|---|---|---|---|
| 2,274,431 | 2/1942 | Renner . | |
| 2,559,376 | 7/1951 | Schnitger | 15/104.05 |
| 2,850,754 | 9/1958 | Davis | 15/210 |
| 2,891,812 | 6/1959 | Gourley | 294/50.6 |
| 2,902,832 | 9/1959 | Levy et al. | 173/128 |
| 3,324,958 | 6/1967 | Clark | 175/84 |
| 3,381,763 | 5/1968 | Matson | 173/132 X |
| 3,444,938 | 5/1969 | Ballmann | 175/173 |
| 3,696,873 | 10/1972 | Anderson | 175/20 |
| 3,817,337 | 6/1974 | Panak et al. | 175/162 |
| 4,098,360 | 7/1978 | Clements | 175/313 |
| 4,106,576 | 8/1978 | Clements | 175/313 |
| 4,315,551 | 2/1981 | Iannone | 173/128 |
| 4,359,110 | 11/1982 | Peterson | 175/20 |

*Primary Examiner*—Stephen J. Novosad
*Attorney, Agent, or Firm*—Zarley, McKee, Thomte, Voorhees & Sease

[57] ABSTRACT

An improved soil sample core extraction tool including a handle member having a soil probe member movable within its longitudinal socket, and having a clutch means for selectively providing for extension, retraction and prevention of movement of the soil probe member with respect to the handle member so that the soil probe member can be inserted into the soil, and retracted with a soil sample, the handle member including a selectively usable jack which assists in retracting the soil probe member from the soil by incrementally lifting the handle member while the soil probe member is engaged by the clutch means, the jack including an extension arm to provide leverage for the jack. The soil probe member is elongated in length and allows for a continuous soil sample to be received in a hollow receptacle within the interior of the soil probe member. A hammer member having a rod with a collar, and a hammer section slidable on the rod, cooperates with the soil probe member to allow a hammer to assist in forcing the soil probe into the soil. A connection assembly allows an extension tube to be removably secured to the soil probe member.

19 Claims, 3 Drawing Sheets

8
106
104
110
102
98
86
30
34
97
99
140
119
108
146
141
143
14
145
139
116
96
112
138
122
100
114
120
118
134
142
132
88
126
94
90
95
92
32
36

SOIL SAMPLE CORE EXTRACTION TOOL

BACKGROUND OF THE INVENTION

1. Field of the Invention:

The invention relates to an improved soil sample core extraction tool, and in particular, to a soil sample core extraction tool which can be used in a variety of conditions for a variety of soil samples.

2. Problems in the Art:

Soil sampling is needed for a variety of reasons. Generally, it is desired to extract a vertical core of soil which can then be preserved and analyzed. This generally requires forceably inserting a soil probe into the soil and then extracting it.

Such a procedure, especially for those who must do so frequently, requires manual exertion of energy, pushing, pulling, and forcing the probe into and then out of the soil. Various tools have been developed to accomplish this task. An easy, efficient, and effective soil sample core extraction tool is disclosed in U.S. Pat. Nos. 4,098,360, and 4,106,576, invented and owned by the present inventor, which are hereby incorporated by reference. These patents disclose, among other things, the general concept of a tool whereby the soil probe can be movable with respect to the tool handle and cooperates with a clutch which allows easier insertion and removal of the soil probe from the ground, even to substantial depths.

There is still a real need for an improved soil sample core extraction tool which can be adapted to a number of different sampling situations, including various soil types and hardness, and for obtaining soil samples of various lengths, or to various depths. It is therefore a principal object of the present invention to provide an improved soil sample core extraction tool which improves over or solves the problems and deficiencies in the art.

A further object of the present invention is to provide a tool as above described which allows greater flexibility in use for and application to soil core extraction.

Another object of the present invention is to provide a tool as above described which is easy to operate, is efficient to use, and is economical.

These and other objects, features, and advantages of the present invention will become more apparent with reference to the accompanying claims and specification.

SUMMARY OF THE INVENTION

The present invention includes a handle member which is elongated and is open throughout its length having an open upper end and an open lower end. It also includes a gripping portion for a user.

A soil probe member is slidably movable within the handle member and itself is open along its length with upper and lower open ends. The soil probe member also has a soil cutting member at its lower end and can include a removable soil sample receptacle within its open middle portion along at least a portion of its length.

A clutch means is manually engageable or releasable from contact with the soil probe member t selectively allow for extension, retraction, and prevention of movement of the soil probe member with respect to the handle member. Thus, the user can utilize the handle member and clutch to forcibly insert the lower end of the soil probe member into the soil for a distance, then operate the clutch to release the soil probe member and raise the handle so that it again can be operated to push the soil probe member further into the soil. Conversely, the clutch can be operated to sequentially pull the probe member out of the soil.

Because the soil probe member can extend all the way through the handle member, a long, continuous soil sample can be obtained, if desired. Additionally, an extension can be removably secured to the top end of the probe member to allow even deeper penetration into the soil. The sample receptacle within the elongated probe member can extend the length of the soil probe member.

A jack means can be operatively secured to the handle member to assist in pulling a probe member out of the soil, especially where the probe member is deeply implanted, or the soil is particularly hard. The jack means has a base and jack extension handle pivotally attached to the handle member which can be used to incrementally extract the probe member from the soil. This is accomplished by allowing the user to use the leverage of the jack extension handle which, when pushed downwardly, causes the clutch to engage and prevent movement of the probe member, while at the same time slightly lifting the handle member from the ground. When the jack extension handle is released, the handle member is returned to abutment with the top of the soil, by pushing down on handles 24, 26, while at the same time the clutch is released from the grip of the probe member, to allow the tool to be ready to raise the probe member the next increment.

Because the handle member has an open upper end, which allows access to the open upper end of the probe member, a hammer means is configured from an elongated rod which has a collar spaced upwardly from its lower end. The hammer portion then is slidable on the rod member so that when the collar abuts the top of the probe member, the hammer can be slid and impacted on the collar which imparts downward force on the probe to assist in driving the probe into the soil, especially into hard soil.

DETAILED DESCRIPTION OF THE PREFERRED EMBODIMENT

Figure 1:
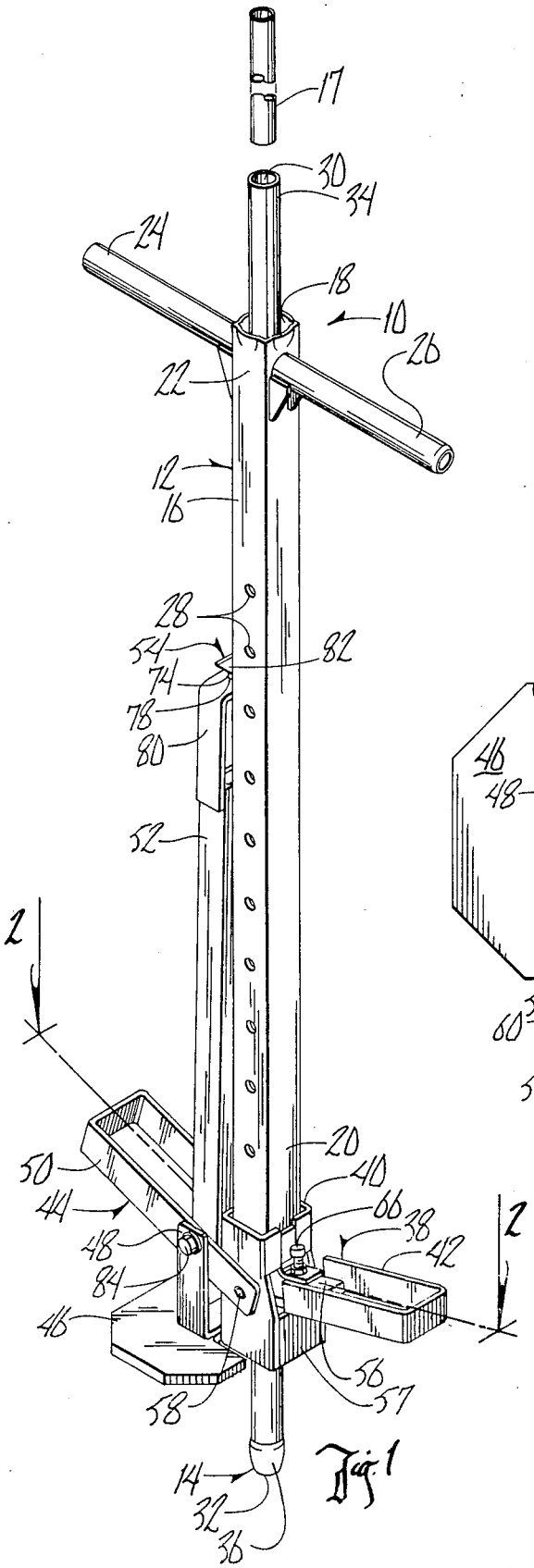
FIG. 1 is a perspective view of one embodiment of the invention.

With reference to the drawings, particularly with respect to FIG. 1, a preferred embodiment of the invention will now be described. An improved soil sample core extraction tool 10 includes a handle member 12 with a soil probe member 14 slidably mounted within handle member 12.

Handle member 12 includes an elongated body portion 16 of generally square cross section having a hollow middle 18 throughout. Both lower end 20 and upper end 22 are open. Handles 24 and 26 extend transversely to body portion 16 at or near the upper end 22 of handle 12.

Spaced apart apertures 28 extend along the longitudinal length of at least one side of body portion 16 of handle member 12. Apertures 28 allow visual verification of the position of soil probe 14 within handle member 12.

Soil probe member 14 is also elongated but is basically in the form of a tube having a circular cross-section. Soil probe 14 also has hollow interior 30 along its length, with an open bottom end 32 and an open top end 34. It is to be understood that in the preferred embodiment, the length of soil probe 14 is greater than the length of body portion 16 of handle 12. In the position shown in FIG. 1, bottom end 32 of soil probe 14 and top end 34 of soil probe 14 both extend beyond the lower and upper ends 20 and 22 of handle 12. Bottom end 32 of soil probe 14 also includes a soil cutting tip 36 which has a hollow longitudinal bore therethrough. Additionally, a removable metal or plastic sample receptacle sleeve or tube 17, having open opposite ends and a hollow interior, matingly and slidably fits within hollow interior 30 of soil probe 14 from its open bottom end 32 a substantial distance towards top end 34. Receptacle tube 17 has no openings in its sidewalls between its open ends to prevent surface contamination of the soil core sample.

Tool 10 also includes a clutch assembly 38 which, in the preferred embodiment, comprises bracket 40 secured to handle 12 near its lower end 20, and a pivotable clutch foot step 42 extending transversely from the longitudinal axis of handle member 12. Clutch assembly 38 operates to selectively provide for the extension, retraction, and prevention of movement of the soil probe member 14 within and with respect to handle member 12. This is accomplished by means which, according to operation of clutch foot step 42, allow clutch assembly 38 to either engage or release the soil probe member 14. Such operation is set forth in detail in U.S. Pat. Nos. 4,106,576, and 4,098,360, owned and invented by the present inventor, and incorporated herein by reference.

FIG. 1 also shows a jack assembly 44 which is pivotally attached to bracket 40 of clutch assembly 38, but on an opposite side of handle member 12 from clutch foot step 42. Jack assembly 44 includes a base 46 which provides a solid support against the soil when used, mounting bracket 48 extending upwardly from base 46, and a pivot bracket 50 which is pivotally secured to bracket 40 of clutch assembly 8 and extends generally transversely outward therefrom, opposite from clutch foot step 42. Jack extension arm 52 is pivotally secured to mounting bracket 48, and can be moved so as to pivot from its folded position (shown in FIG. 1), to a position abutting against the top of pivot bracket 50 (see FIG. 5), so as to exert leverage force on pivot bracket 50. When not in use, jack extension arm 52 is secured by a securing bracket 54 attached to the side of body 16 of handle 12.

Figure 2:
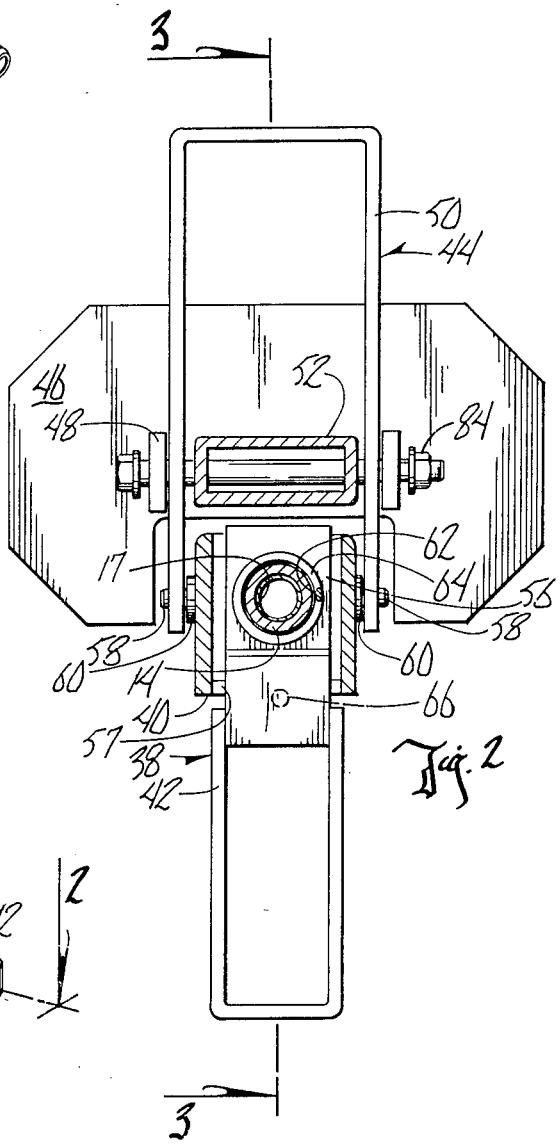
FIG. 2 is a sectional view taken along lines 2—2 of FIG. 1.

It is to be noted that pivot bracket 50 is pivotally attached to bracket 40 of clutch assembly 38 by pivot pins 58. By referring to FIGS. 2 and 3, it can be seen that clutch foot step 42 is secured to an engagement plate 56 which surrounds soil probe member 14 inside of handle member 12. Engagement plate 56 and clutch foot step 42 are pivotable on fulcrum 57 (which is formed by a vertically extending wall of bracket 40 and is laterally spaced apart from soil probe member 14). As disclosed in the Letters Patents incorporated by reference, biasing means holds engagement plate 56 in a position whereby it engages soil probe 14 to prevent it from downward movement. Selective operation of clutch foot step 42 frees all engagement of engagement plate 56 with probe member 14 to allow probe member 14 to move in either direction with respect to handle member 12. Finally, complete depressing of foot step 42 locks soil probe member 14 from movement in any direction.

By comparison, pivot bracket 50 of jack assembly 44 is pivotally connected by pivot pins 58 to bracket 40, which is connected to body 16 of handle member 12 and secured there by securing means 60 known within the art.

Figure 3:
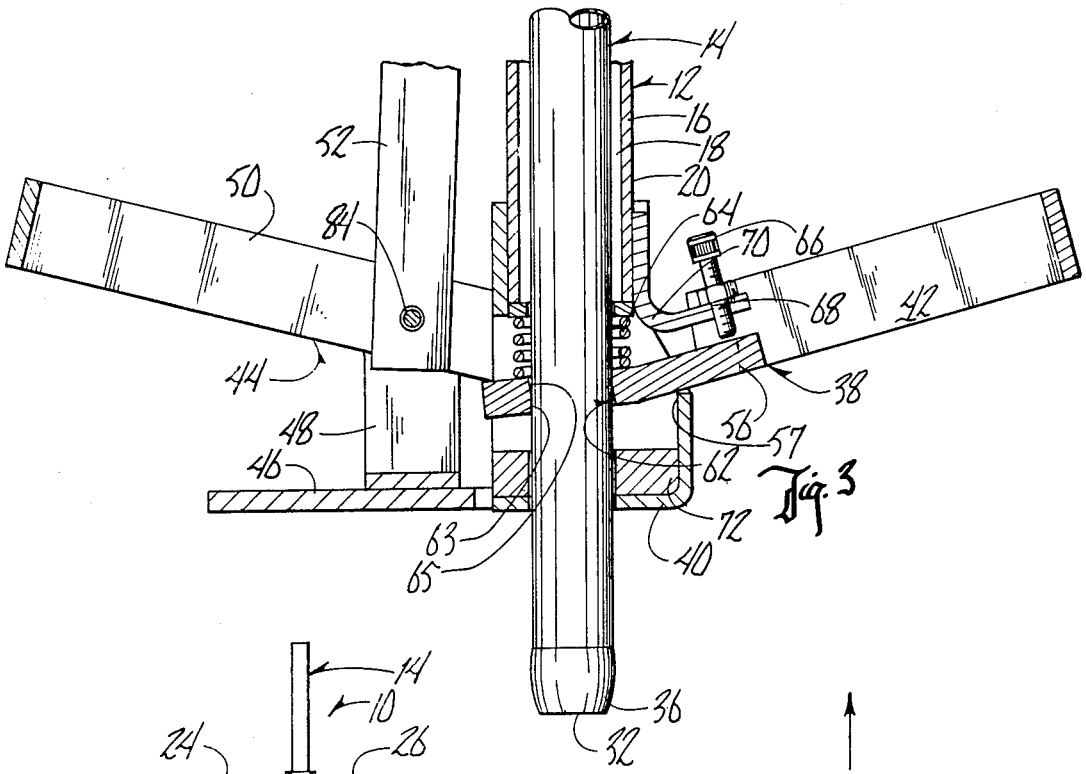
FIG. 3 is a partial sectional view taken along lines 3—3 of FIG. 2.

FIG. 3 shows in more detail the relationship of the clutch assembly 38 and jack assembly 44 with the soil probe member 14. It can be seen that engagement plate 56 includes aperture 62 through which soil probe member 14 extends. Aperture 62 is of unique shape to facilitate the operation of tool 10. As explained in the U.S. Letters Patent incorporated by reference (see especially FIG. 2 and column 4, lines 51–68, and column 5, lines 1–23 of those patents), aperture 62 preferably has a pair of oppositely directed substantially coaxial frusto-conical shaft-engaging surfaces 63 and 65, which function is described therein. Aperture 62 is of somewhat greater diameter than the outer diameter of soil probe member 14 to allow soil probe member to slidably move therein. Surfaces 63 and 65 allow engagement plate 56 to pivot slightly in either direction with respect to probe member 14. The surfaces 63 and 65 defining aperture 62 therefore can engage soil probe member 14 to hold it in certain positions. Compression spring 64 biases engagement plate 56 downward when no pressure is put on foot step 42 to keep it angled with respect to soil probe 14. Adjustment screw 66 threadably moves through aperture 68 and adjustment plate 70, which is secured to handle member 12, and serves as a limit for the upward movement of engagement plate 56. This is particularly of importance when soil probe member 14 is stuck in the soil and is being pulled out by tool 10. Screw 66 is adjusted to stop upward movement of plate 56 when handle member 12 is being pulled up or jacked up, as will be described herein. Screw 66 assists in not allowing plate 56 to tilt in attitude to probe member 14 so as to prevent plate 56 from being slidable upwardly along probe member 14.

FIG. 3 also shows the relationship of the bottom of base 46 with respect to bracket 40 of clutch assembly 38. A bushing 72 exists inside the bottom of bracket 40 to assist in smooth slidable movement of soil probe member 14. Bracket 40 serves as a cantilever or fulcrum when force is exerted upon clutch footstep 42 to push soil probe 14 down into the soil.

Figure 4:
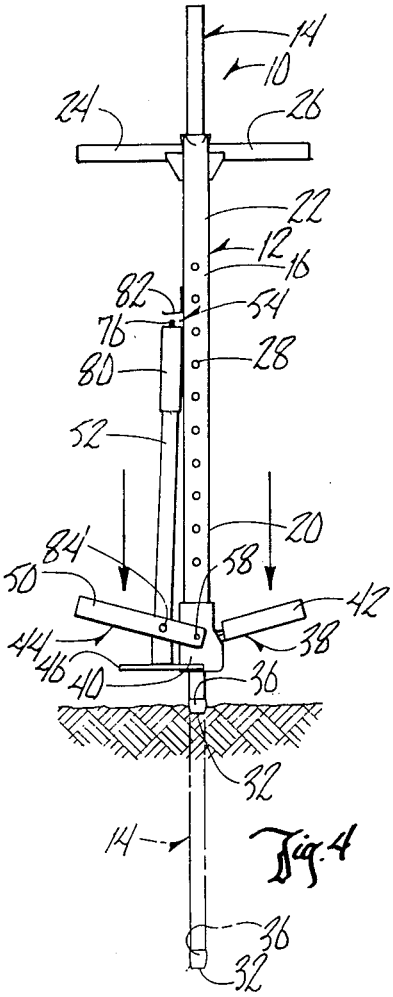
FIG. 4 is an elevational schematic view depicting operating of the invention according to the embodiment shown in FIG. 1 insert the soil probe member into the soil.
Figure 5:
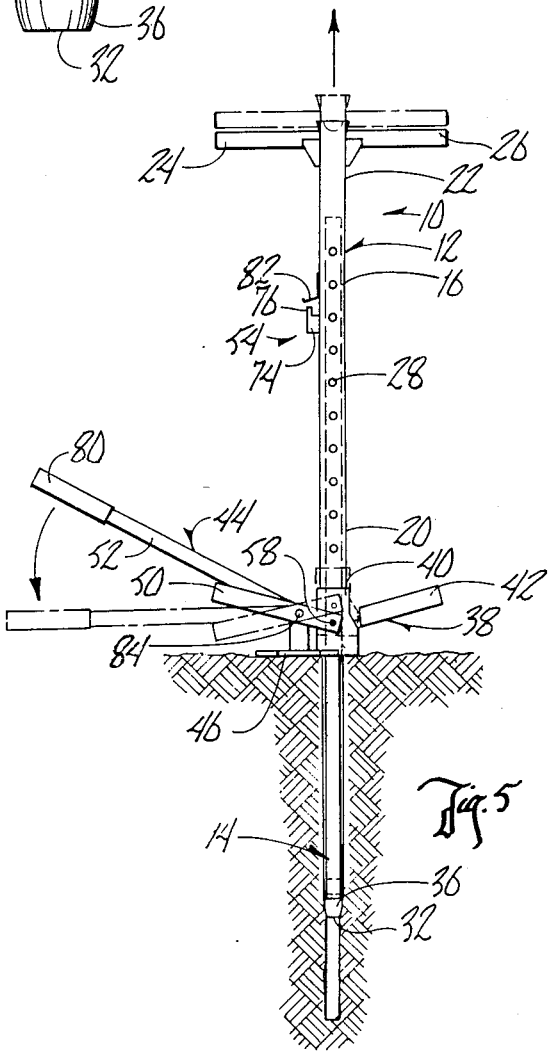
FIG. 5 is a schematic depicting operating of the invention according to the embodiment of FIG. 1 to jack the soil member from the soil.

FIGS. 4 and 5 depict some of the operations of tool 10. In FIG. 4, it can be seen that when jack extension arm 52 is pivoted upwardly and secured in place along body portion 16 of handle member 12, it basically locks pivot bracket 50 from movement with respect to handle member 12. Pivot bracket 50 therefore can serve as an additional foot step which the user can utilize to increase downward force on soil probe 14. In effect, the user can step down on clutch foot step 42 to lock soil probe 14 from any movement, position soil probe 14 so as to begin entry into the ground, and then step on foot step 42 alone, or in combination with pivot bracket 50, to drive soil probe 14 into the ground. Clutch assembly 38 can then be operated to allow the lifting of the handle member 12 upwardly, and then clutch foot step 42 (and pivot bracket 50 if needed) can again be operated to drive soil probe 14 further into the ground, such as is explained in the above mentioned patents incorporated by reference.

FIGS. 4 and 5 depict how jack extension arm 52 is secured along the side of handle member 12 by securing bracket 54. Securing bracket 54 includes a lower L-shaped arm 74 extending transversely from the side of body portion 6 and handle member 12. The upward extending portion 76 of L-shaped arm 74 is configured to enter a slot 78 (see FIG. 1) in the upside down U-shaped top end 80 of extension arm 52. The hingeable nature of jack assembly 44 with respect to handle member 12 allows extension arm 52 to be moved slightly upwardly, over, and then down upon upward extension portion 76 of L-shape 74. A cover bracket 82 is secured to handle member 12 and extends over the top of upward extension portion 76 of L-shaped arm 74, but is spaced apart enough to allow extension arm 52 to be engaged with L-shaped arm 74. Cover bracket 82 prevents extension arm 52 from being jolted upwardly and out of securement with L-shaped arm 74.

FIG. 5 depicts the jacking operation of jack assembly 44. Jack extension arm 52 is removed from L-shaped arm 74 and pivoted downwardly until it abuts the top of pivot bracket 50. It is used to assist in removing soil probe member 14 from the ground.

Tool 10 is prepared for jacking by putting it in the configuration shown by solid lines in FIG. 5. It can be seen that base 46 of jack assembly 44 is flat against the top of the soil. Also, clutch foot step 42 is released and not depressed, which means that the clutch assembly 38 is engaging the soil probe member 14 so that any upward move of handle member 12 will also pull upwardly on soil probe member 14.

Jack extension arm 52 forms a lever with pivot bracket 50 with the pivot point being pivot pin 84 which goes through mounting bracket 48. One end of the lever is top end 80 of extension arm 52. The other end of the lever is the junction of pivot bracket 50 with handle member 12 at pivot pins 58.

By using a foot and leg, extension arm 52 is depressed downwardly, which in turn causes the opposite end of that combined lever arm to raise handle member 12 a short distance, using pivot pin 84, mounting bracket 48 and base 46 as a kind of combined fulcrum. Tool 10 would end up approximately in the position shown by broken lines in FIG. 5 after one depression of extension arm 52. The result of this step is that the lowermost end of soil probe member 14 would be pulled upwardly a distance, using the mechanical advantage of jack assembly 44. It is to be understood that because of the conventional operation of clutch assembly 38, after depression of extension arm 52 to raise handle member 12 and soil probe 14 the incremental distance, extension arm 52 is released, handle member 12 is pushed back down towards the soil, and soil probe member 14 slides within handle member 12. Tool 10 is then ready for another depression of extension arm 52 for another incremental movement of soil probe member 14 upwardly. By this ratcheting-type action, soil probe 14 can be incrementally, and easily, removed from soil; particularly hard soil, or where soil probe 14 is inserted deeply into the soil.

Figures 6, 7, 8:
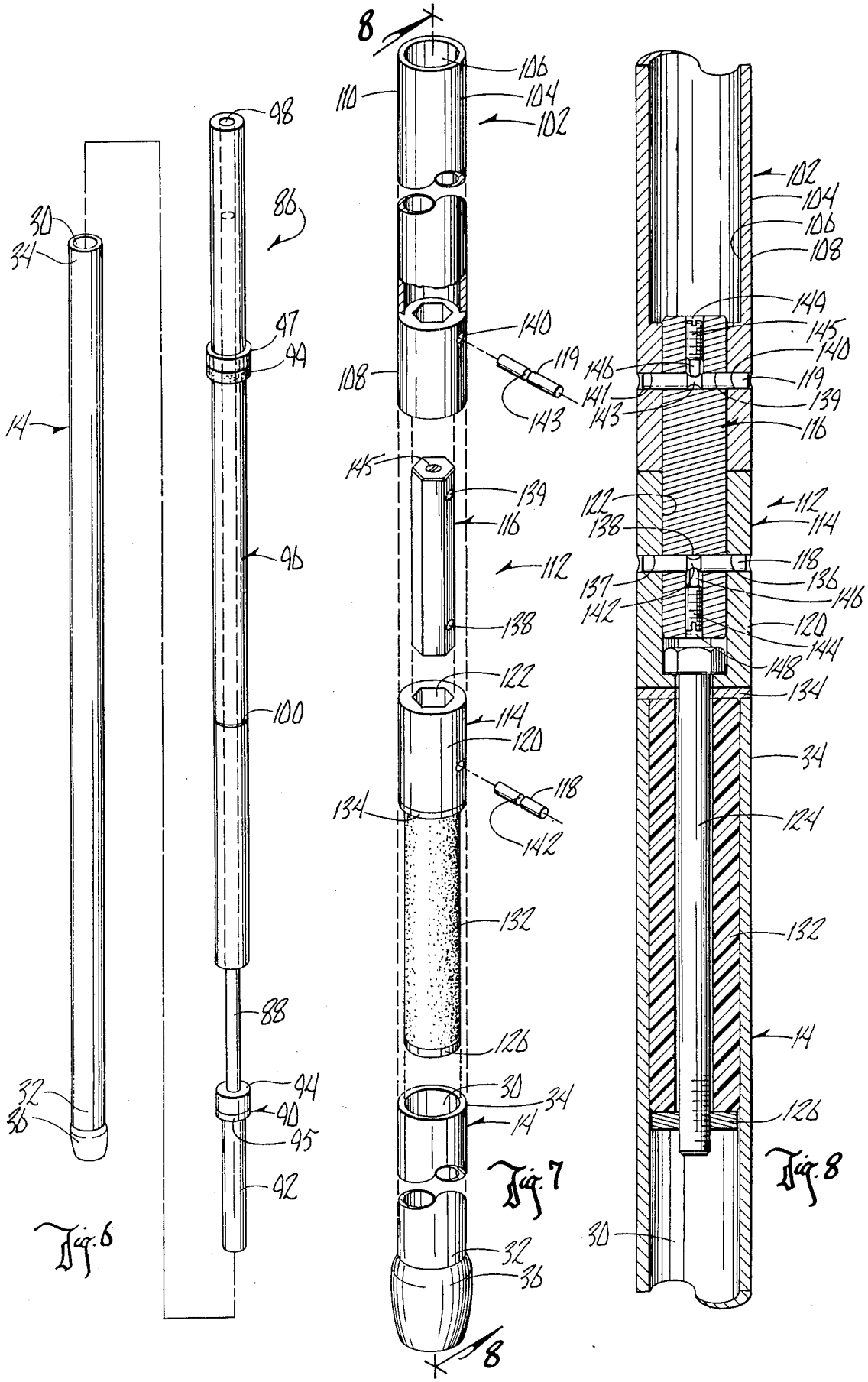
FIG. 6 is an isolated perspective view of a hammer mechanism which can be used with the soil probe according to the present invention.
FIG. 7 is an exploded perspective view of a soil probe extension member and the soil probe according to the present invention.
FIG. 8 is a sectional view taken along lines 8—8 of FIG. 7.

FIG. 6 depicts a hammer assembly 86 which cooperates with tool 10 to assist in driving soil probe member 14 into the ground. Hammer assembly 86 is particularly useful in hard ground, or where the soil probe 14 is required to reach deeply into the soil. Hammer assembly 86 includes an elongated rod 88 having a first end 90 which includes an insertion portion 92, a collar 94, and aluminum spacer 95. The insertion portion 92 is configured to fit within hollow interior 30 of soil probe member 14, and it is preferred that it basically matingly fit therein. Collar 94 and spacer 95 have a diameter larger than hollow interior 30 of soil probe member 14, and approximately equal to the outside diameter of hammer member 86 which is freely slidable within hollow middle 18 of handle member 12. Collar 94, and in particular the aluminum spacer 95, provides the point of impact between hammer assembly 86 and soil probe member 14. The softer aluminum spacer 95 is positioned between the lower surface of collar 94 and the upper end of soil probe member 14 to prevent the deformation of the upper end of soil probe member 14 as the result of repeated, forceful impacts of hammer portion 96 of hammer assembly 86.

Hammer portion 96 of hammer assembly 86 has a middle longitudinal bore 98 so that it can be slidably moved over elongated rod 88. Hammer portion 96 is preferred to be made of material that is rigid and has sufficient mass to provide significant hammering force to collar 94. Furthermore, a stop collar 97 can be moveably secured along the exterior of hammer portion 96 with a rubber bumper 99 directly beneath it. Collar 97 and bumper 99 could serve to give the user an automatic stop to prevent probe member 14 from being driven too far, or can serve as an indicator of the end limit of movement.

In operation, tool 10 is set up so as to be prepared for driving soil probe member 14 into the ground. Insertion portion 92 of hammer assembly 86 is then inserted into hollow interior 30 of soil probe member 14 as it stands within handle member 12. Aluminum spacer 95 of collar 94 then rests on the top of soil probe 14, and hammer portion 96 of hammer assembly 86 is raised and then brought quickly downwardly into contact with the top of collar 94 to provide hammering force to soil probe 14. It is to be understood that hammer portion 96 may optionally contain markings 100 which will give the user an indication of how deeply the soil probe member 14 is being driven. It is also to be understood that clutch assembly 38 needs to be operated to release engagement with soil probe member 14 during any hammering action. Hammer assembly 86 therefore allows easy driving of soil probe member 14, especially into hard soil or to deep depths.

FIG. 7 depicts a soil probe extension 102, which can be used to extend the length of soil probe 14. This is desirable in some circumstances where a soil sample is desired from a distance deeper than attainable by soil probe member 14 alone. It is to be understood that no soil can enter soil probe extension 102, but that it merely extends the distance to which soil probe member 14 can extend.

Soil probe extension 102 includes a tube 104 which is basically of the same diameter as soil probe member 14 and has a hollow interior 106 with open lower end 108 and open upper end 110. Tube 104 is connected to soil probe member 14 by connection assembly 112 which consists of a connector member 114, locking hex key 116, and locking grooved pins 118, 119. As can be seen in FIGS. 7 and 8, connector member 114 itself consists of hex socket member 120 having a bolt 124 rigidly mounted at the bottom of hex socket 122 and extending outwardly therefrom. The distal end of bolt 124 is threadably received in threaded end cap 126. An elastomeric member 132 surrounds bolt 124 and is retained at opposite ends by end cap 126 and an aluminum spacer 134, which rotatably abuts the bottom of hex socket member 120. Bolt 124 holds end cap 126 against elastomeric member 132 so that elastomeric member 132 is sandwiched between end cap 126 and hex socket member 120. It is to be understood that in the preferred embodiment, end cap 126 is of a smaller outer diameter than the inside diameter of soil probe member 14, and that the outer diameter of elastomeric member 132 is roughly the same as the inside diameter of soil probe member 14. Elastomeric member 132 can then be frictionally inserted into the hollow interior 30 of soil probe member 14. It is to be further understood, however, that rotational movement of hex socket member 120, in the direction so that the threads of bolt 124 cause end cap 126 to draw towards hex socket member 120, in turn causes elastomeric member 132 to deform and expand laterally so as to increase and assure its securement within soil probe member 14.

Such tightening of bolt 124 can be accomplished by utilizing a wrench with respect to hex socket 122. Alternatively, because the lower end 108 of probe extension 102 has a hexagonal shape which matingly fits over hexagonal key 116, which in turn fits within hex socket 122 of hex socket member 120, tube 104 of extension 102 can itself be used as a type of wrench to turn hex socket member 120 to expand or diminish the width of elastomeric member 132. Hex socket member 120, hexagonal key 116, and extension tube 104 all have apertures (designated by reference numerals 136, 137, 138, 139, 140 and 141), which are also alignable with one another when hex key 116 is matably inserted into hex socket member 120, and extension tube 104 is matingly overlayed over the top of hex key 116. Locking pins 118 and 119 can then be inserted through aligned apertures 136, 137, 138, 139, 140 and 141, respectively, to lock soil probe extension 102 to soil probe member 114. Locking pins 118 and 119 have middle grooves 142 and 143 which cooperate with the spring loaded ball plungers 144 and 145 which are threadably inserted in interior bores 148 and 149 at opposite ends of hex key 116. The perimeter of balls 146 of ball plungers 144 and 145 are allowed to extend into aperturss 138 and 139 and serve as a biased retaining means for pins 118 and 119 by resiliently seating into grooves 142, 143 of pins 118 and 119.

To remove extension 102 from soil probe member 114, the procedure is reversed, namely, extension 102 is rotated in a direction whereby elastomeric member 132 of connector member 114 is reduced in diameter to the point where all of connector member 114, hex key 116, and extension 102 can be removed from probe member 114. Locking pins 118 and 119 can then be removed by gently tapping one of their ends and then pulling them out of the aligned apertures. Hex key 116 can then be separated from tube 104 and connector member 114.

The included preferred embodiment is given by way of example only, and not by way of limitation to the invention, which is solely described in the claims herein. Variations obvious to one skilled in the art will be included within the invention defined.

It is to be noted that in instances where hammer assembly 86 is not used to drive soil probe member 14 into the soil, to ensure that soil receptacle 17 does not move within hollow interior 30 of soil probe member 14, connector member 114 can be inserted and secured to top end 34 of soil probe member 14. End cap 126 of connector member 114 would abut the top end of soil receptacle 17 and prevent any upward movement.

What is claimed is:

1. A soil sample core extraction tool comprising:

a handle member;

a soil probe member having a receptacle for retention of a soil sample, said probe movably mounted on the handle member;

clutch means for selectively providing for extension, retraction and prevention of movement of the soil probe member with respect to the handle member to permit manipulation of the handle member to a constant convenient position during an entire sampling operation, the handle member being provided with a longitudinal socket, and the soil probe member being slidably deposed in the socket of the handle member, with the clutch means being mounted on the handle member for movement relative to said longitudinal socket and arranged for selectively engaging and releasing soil probe member, said clutch having means to urge said clutch to a pull position wherein said soil probe member is non-extendible but is retractable, and further having a neutral position wherein said soil probe member is both extendible and retractable, and a push position wherein the soil probe member is locked to prevent retraction; and jack means to assist retraction of the soil probe member from the ground and with respect to the handle member, said jack means being mounted on the handle member for movement relative to said longitudinal socket and arranged for selectively engaging and releasing the soil probe member and having means to urge said jack means to an upward jacking position wherein said soil probe member is engaged and moved upwardly in the longitudinal socket, and having means to urge said jack means to a return position wherein said jack means is positioned to repeat jacking movement of the soil probe member upwardly in the longitudinal socket

2. The tool of claim 1 wherein said jack means includes a jack extension handle extending outwardly from the handle member for engagement and operation by the foot of a person using the tool.

3. The tool of claim 1 wherein said jack means includes a base member which is adapted to contact the ground when the tool is in use, said base member being pivotally attached to the jack means and being movable with respect to the handle member.

4. The tool of claim 3 wherein the jack means includes a jack extension handle which is pivotally attached to the base member.

5. The tool of claim 1 wherein the jack means extends from an opposite side of the handle member from that of the clutch means.

6. The device of claim 1 wherein the jack means includes means for selectively engaging and releasing the shaft of the soil probe member.

7. The tool of claim 6 wherein the means for selectively engaging and releasing the shaft of the soil probe member for the jack means is the same as that for the clutch means.

8. The tool of claim 1 wherein the jack means further comprises a second jack extension handle which is pivotable with respect to the jack means and extends outwardly beyond any other part of the jack means to provide additional leverage for operation of the jack means.

9. A soil sample core extraction tool, comprising:

an elongated handle member having a longitudinal axis and having first and second open ends;

an elongated soil probe member having a hollow interior for retention of a soil sample, said probe member movably mounted on the handle member within a hollow interior of the handle member, said probe member being at least as long as the handle member; and clutch means for selectively providing for extension, retraction and prevention of movement of the soil probe member with respect to the handle member to allow said soil probe member to be inserted into soil to take a continuous soil sample along approximately the entire length of the soil probe member.

10. The tool of claim 9 wherein the soil probe member is round in cross section and has a round-in-cross-section hollow bore throughout its length.

11. The tool of claim 9 wherein the soil probe member includes a soil cutting means at its leading end with respect to the soil.

12. The tool of claim 9 wherein said handle member includes view openings spaced along its length to allow a user to visually confirm the position of the trailing end of the soil probe member within the handle member.

13. A hammer means for use with a soil sample core extraction tool to assist in driving a soil probe member into the soil, said extraction tool including an elongated handle member having a longitudinal axis and a hollow interior for movable retention of the soil probe member, and having first and second open ends, the hammer means comprising:

an elongated rod member having first and second ends, said first end being slidably and removably insertable through an open end into the hollow interior of the handle member and an end opening of a soil probe member, said first end being generally matably positionable within the interior of the end opening of the soil probe member and including a collar member of a outside diameter greater than the end opening the soil probe member so that the collar will abut against an end of the probe member, but less than the diameter of the open end and hollow interior of the handle member; and a hammer member of elongated shape having a central bore along its longitudinal axis and outside diameter less than the diameter of the open end and hollow interior of the handle member for matable sliding reception of the elongated rod member between the second end and the collar member, so that by slidably raising and then slidably accelerating and impacting the handle member along the rod member onto the collar member, when the rod member is positioned in the handle member of the extraction tool, the hammering force will be exerted through the collar member against the soil probe member to drive it into the soil.

14. A soil probe member extension for a soil probe member of a soil sample core extraction tool, wherein the soil probe member includes a longitudinal tube having an open longitudinal bore with a first end including a soil cutting member, and the second end being open, comprising:

an extension tube of elongated shape having first and second open ends, and an open longitudinal bore, said extension tube being of approximately the same outside diameter as the soil probe member;

an extension connection means comprising a base having a diameter greater than the inside diameters of the longitudinal bores of either the soil probe member or the extension member, an elastomeric member positioned below the base member and extending downwardly therefrom, said elastomeric member having a diameter approximately equal to the inside diameter of the longitudinal bore of the soil probe member so that it can be frictionally inserted into the longitudinal bore of the soil probe member, and means to deform the elastomeric member radially and expansively so that when the elastomeric member is inserted within the longitudinal bore of the soil probe member, the elastomeric member can be deformably expanded radially outwardly to grip and be secured within the longitudinal bore of the soil probe member;

locking means for locking the extension tube to the base member of the connection member, so that the extension member can be secured to the soil probe member, said locking means being configured so that it does not extend outside of the outside diameter of the extension tube or the soil probe member.

15. The tool of claim 14 wherein the connector member further comprises a hexagonal socket associated with the top of the base, a hex key matable into the hexagonal socket and matable into an end of the extension tube, said hexagonal socket, hex key, and extension tube have alignable apertures transverse to the longitudinal axis of each for insertion of pin members to secure the extension tube to the base member.

16. The tool of claim 14 wherein the connector member further comprises a threaded end cap at the bottom of the elastomeric member, and a bolt threadably extending through the end cap, elastomeric member, and being secured into the base member, so that by turning the base member relative to the elastomeric member, the end cap is pulled toward the base, thereby deforming the elastomeric member radially outwardly.

17. The means of claim 13 wherein the first end of the elongated rod member is generally wider in diameter than the remainder of the elongated rod member, but of smaller diameter than the diameter of the stop collar.

18. The means of claim 13 further comprising an annular spacer member positioned in abutment to the stop collar, on the side of the stop collar adjacent to the first end of the elongated rod member, said spacer being made of a material which is less rigid than the stop collar.

19. The means of claim 13 further comprising a stop collar means adjustably positionable along the exterior of the hammer member, said stop collar indicating the limit of travel in the open end of the handle member of the extraction tool, and the interior of the handle member during hammering of the soil probe member.

* * * * *